United States Patent [19]

Steiner

[11] Patent Number: 4,620,481

[45] Date of Patent: Nov. 4, 1986

[54] INKING UNIT FOR A PRINTING MACHINE

[75] Inventor: Gerd Steiner, Heusenstamm, Fed. Rep. of Germany

[73] Assignee: M.A.N.-Roland Druckmaschinen Aktiengesellschaft, Fed. Rep. of Germany

[21] Appl. No.: 752,248

[22] Filed: Jul. 3, 1985

[30] Foreign Application Priority Data

Jul. 5, 1984 [DE] Fed. Rep. of Germany ..... 3424721

[51] Int. Cl.[4] ..... B41F 31/14; B41F 31/34; B41L 27/16

[52] U.S. Cl. ..... 101/350; 101/DIG. 14

[58] Field of Search ..... 101/348, 349, 350, 351, 101/352, DIG. 14, 148, 207-210

[56] References Cited

U.S. PATENT DOCUMENTS 2,300,549 11/1942 Huck ..... 101/DIG. 14

3,983,812 10/1976 Schramm ..... 101/DIG. 14

*Primary Examiner*—J. Reed Fisher

*Attorney, Agent, or Firm*—Leydig, Voit & Mayer, Ltd.

[57] ABSTRACT

In an inking unit, the ink is taken in metered quantities from an ink reservoir and distributed by inking rollers to form an ink film adapted to be applied by ink applicator rollers to a printing plate. To avoid mottling, an ink applicator roller is moved axially in the phase of a machine cycle during which the ink applicator roller is not in engagement with the printing plate. During the ink application, on the other hand, the ink applicator roller performs either no axial movement or only a slight axial movement. This avoids an undesirable increase of the size of the screen dots and improves the print quality.

8 Claims, 3 Drawing Figures

INKING UNIT FOR A PRINTING MACHINE

FIELD OF THE INVENTION

This invention relates generally to an inking unit for a printing machine and more particularly concerns a rotary offset printing machine, in which the ink is taken from an ink reservoir in metered quantities and distributed by inking rollers to form an ink film which is adapted to be applied to a printing plate by means of an axially displaceable ink applicator roller.

BACKGROUND OF THE INVENTION

In printing machine inking units one common problem is to supply a uniform thin film of ink to the printing plate over its entire length. In many instances, however, the ink distribution is so unfavorable that uniformity cannot be completely achieved, so that printing errors occur in the form of visible ink intensity differences or "mottling". In an attempt to obviate mottling, in a known inking unit for printing machines such as disclosed in German patent specification 30 34 644, the last ink applicator roller in the direction of rotation of the cylinder and another ink applicator roller are constructed as distributing rollers which perform a side traverse motion and the frequency of movement of which differs from whichever of the ink distributing rollers is in contact at any time. The disadvantage of this known inking unit is that the side traverse movement of the applicator rollers may cause distortion and increased size of the screen dots, particularly at high printing speeds, thus impairing the print quality. Also, the standstill on the change of direction of the side traverse movement may cause printing errors.

OBJECTS AND SUMMARY OF THE INVENTION

The primary object of the invention is to provide an inking unit of the kind referred to hereinbefore which guarantees uniform inking of the printing plate and obviates printing errors due to mottling and increased size of screen dots.

To this end, according to the invention, the axially displaceable ink applicator roller performs no axial movement or only a slight axial movement during application of ink to the printing plate and an axial displacement of the ink applicator roller is effected in the phase of a machine cycle in which the ink applicator roller is not in engagement with the printing plate. To avoid mottling, therefore, the ink applicator roller is axially moved to and fro in synchronized timing only during each passage of the blank matter, so that there is no longer any impairment of the ink transfer to the printing plate due to an axial sliding movement of the ink applicator roller. Thus with the inking unit according to the invention it is possible to obtain perfect print quality even with an unfavorable printing subject. Another advantage of the invention is that the ink flow is increased and the magnitude of the axial travel of the ink applicator roller is not limited by the requirements associated with the ink transfer.

According to another object of the invention, the magnitude of the axial movement of the ink applicator roller is adjustable. This is advantageous for optimum adjustment of the effect of the axial displacement of the ink applicator roller to the printed subject. For example, if a strip pattern is to be printed, it is necessary to adjust the axial travel of the ink applicator roller to a value differing from the strip spacing in order to avoid mottling. It has also been found that the inking unit according to the invention satisfies the various practical requirements if the magnitude of the axial movement of the ink applicator roller is between 6 mm and half the width of the inking zone of an ink dispensing element.

It is a further aspect of the invention that in an inking unit comprising a plurality of axially displaceable ink applicator rollers, the axial displacement of all the ink applicator rollers is effected in the phase of the machine cycle in which they are not in engagement with the printing plate and the movement of adjacent ink applicator rollers advantageously is contra-directional. Preferably, the individual ink applicator rollers have different amounts of axial travel.

In order to eliminate even minimum mottling effects, according to a still further object of the invention, one or more ink applicator rollers perform a slight and substantially uniform axial distributing movement during engagement with the printing plate. According to this embodiment of the invention, it is adequate if the axial distributing movement is between about 1 and 2 mm per printing plate passage. A small axial distributing movement of this kind is sufficient to eliminate abrupt transitions between zones of different inking density without any adverse effects on ink transfer.

These and other objects and advantages of the invention will become apparent upon reading the following detailed description of the invention and upon reference to the drawings, in which:

While the invention has been described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

DETAILED DESCRIPTION OF THE ILLUSTRATED EMBODIMENT

Figure 1:
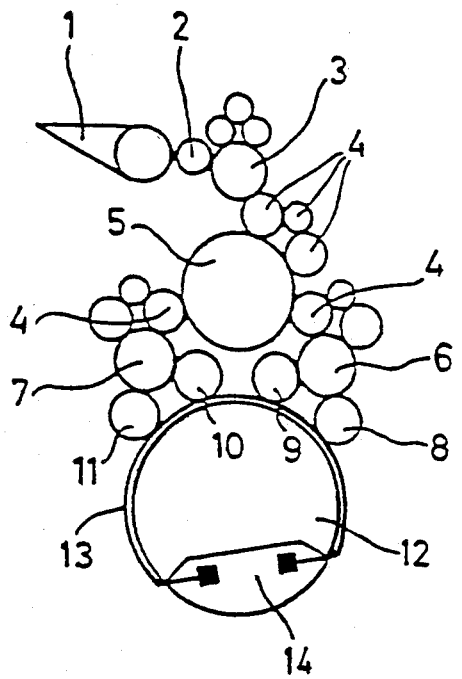
FIG. 1 is a diagrammatic side elevation of a roller inking unit of a rotary offset printing machine.

In the roller inking unit shown in FIG. 1, the ink is dispensed from an ink reservoir 1 and transferred via a vibrator 2 to a first distributing roller 3. Associated with the latter are a plurality of transfer roller 4 which transfer the ink to a second distributing roller 5. From there the ink passes by way of other transfer rollers 4 to third distributing rollers 6 and 7. From the latter the ink is transferred to ink applicator rollers 8–11 which feed the ink in finely divided form to a printing plate 13 on the plate cylinder 12.

To avoid mottling, whenever the blank part 14 of the plate cylinder 12 moves past the ink applicator rollers 8–11, the rollers are axially displaced a certain amount alternately in either direction. Preferably, the adjacent applicator rollers move in opposite directions so that, for example, the applicator rollers 8 and 10 move into the plane of the drawing and the applicator rollers 9 and 11 move out of the plane of the drawing and vice-versa correspondingly on the next passage of the blank part 14.

Figure 2:
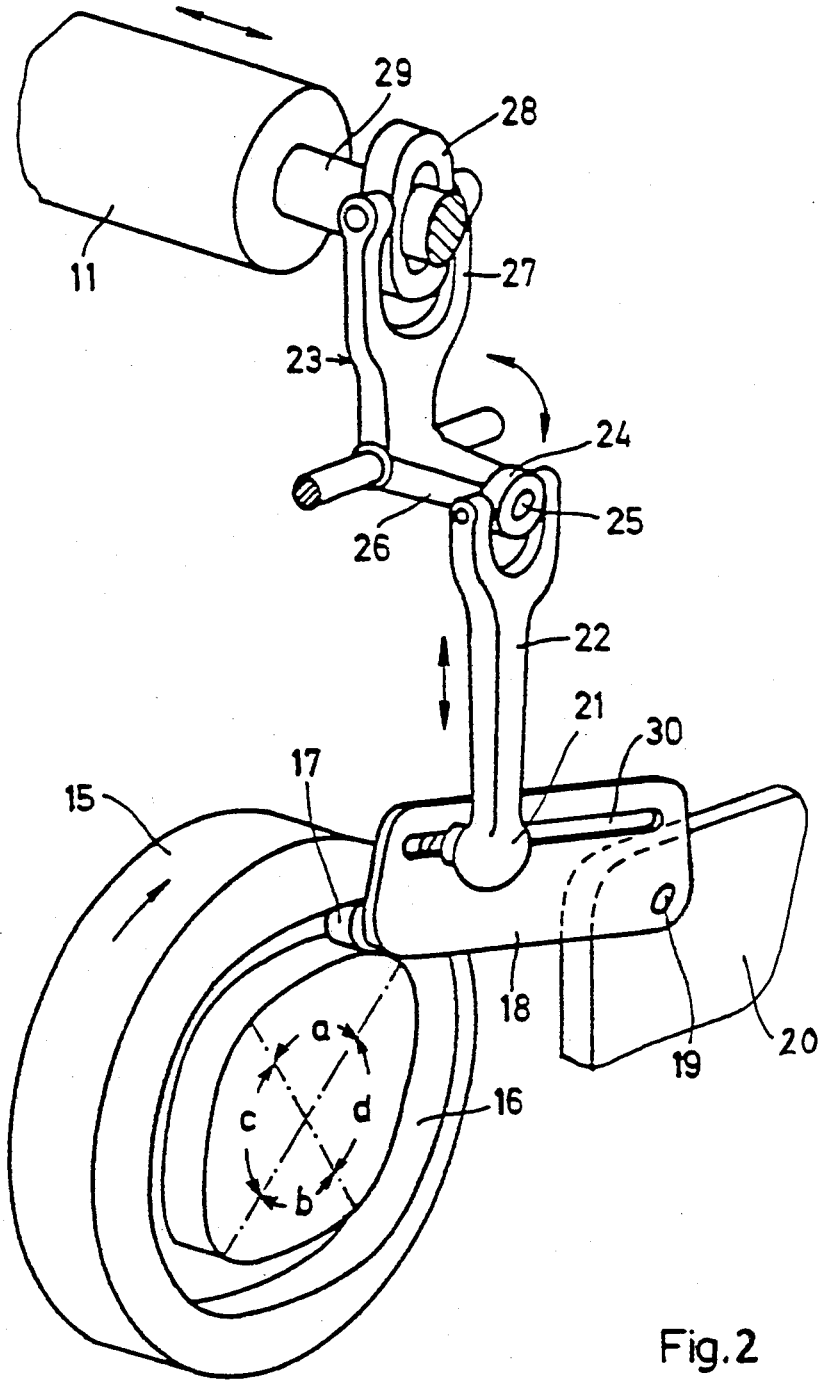
FIG. 2 is a perspective diagrammatic view of a drive mechanism for axial displacement of an ink applicator roller.

The axial displacement of the ink applicator rollers during the passage of the blank matter can be effected by various kinds of devices. Illustrated in FIG. 2 is a preferred mechanical device of relatively simple construction in which the axial movement of the applicator roller 11 is generated by a cam disc 15 driven by the printing machine and having a camming groove 16. A cam follower roller 17 engaged in the groove 16 rocks a one-armed lever 18 mounted by a boss 19 on a cross-member 20 connected to the machine frame. A push rod 22 is secured to the lever 18 by a ball-and-socket joint 21 and transmits the movement to a bell crank 23 mounted to pivot on the machine frame transversely to the axis of the applicator roller 11. To this end, a bearing block 24 is mounted rotatably in the forked end of the push rod 22 and is in turn mounted rotatably on a pin 25 at the end of the arm 26 of the bell crank 23. A transmission ring 28 is rotatably secured to the other forked arm 27 of the bell crank 23 and is displaceably inserted in an annular groove in the trunnion 29 of the roller 11 for displacement in the longitudinal direction of the arm 27 and transmits the rocking movement of the arm 27 to the roller 11. It will be understood that the trunnion 29 is also journalled for rotation and axial movement in a suitable bearing (not shown) supported on the machine frame.

To ensure that the ink applicator roller 11 is moved alternatively axially to and fro only on the passage of the blank part 14 of the plate cylinder 12, the cam disc 15 is driven at half the speed of the plate cylinder and has zones a and b each traversed by the roller 17 on the passage of the blank part of the cylinder and a transition from an arcuate outer radial cam zone d to an arcuate inner radial cam zone c. It will be understood that the arcuate radial zones c and d are traversed by roller 17 during inking of the printing plate 13 by the ink applicator roller 14.

When the cam disc 15 starts to rotate in the clockwise direction from the position illustrated in FIG. 2, the lever 18 is moved downwards in the zone of the cam section a and the ink applicator roller 11 is moved to the right. As soon as the cam zone c engages roller 17, the lever 18 and roller 11 remain essentially stationary in their displaced position. On the subsequent passage of the roller through cam zone b, the lever 18 moves up and roller 11 moves to the left until they have resumed the position illustrated and again stop on entry of the roller 17 into the cam zone d.

Figure 3:
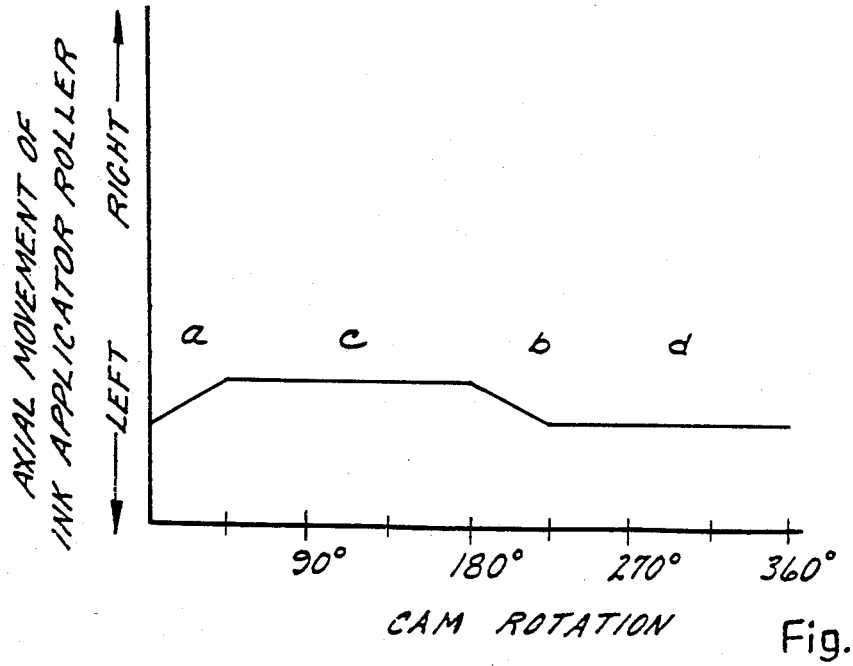
FIG. 3 is a graph illustrating the axial movement of the ink applicator roller as a function of cam rotation for an illustrative embodiment of the invention.

In an illustrated embodiment, the printing portion of the plate 13 may cover 270° of the cylinder 12 and the blank or uncovered portion 14 accounts for the remaining 90° of the cylinder circumference. As illustrated by the graph of FIG. 3, the applicator roller 11 moves to the right during the 45° rotation of the cam disc 15 while the roller 17 is in zone a and then essentially no axial movement occurs while the roller 17 is in zone c. Thereafter, as the roller 17 engages zone b, the applicator roller 11 moves back to the left and then dwells there as the roller 17 passes through cam zone d. Of course, other movement and dwell times can be provided to suit the particular printing and blank portions on the cylinder surface by simply changing the relative lengths of the cam zones a:c and b:d.

To enable the magnitude of the axial movement of the roller 11 to be adjusted, the lever 18 has a slot 30 in which the ball-and-socket joint 21 can be secured at any desired place. In this way, the movement of the push rod 22 can be adjusted steplessly to zero from the maximum height of the camming groove 16. With the system described it is also possible to obtain a slight axial distribution movement on the order of between about 1 to 2 mm for the ink applicator roller 11 during inking of the printing plate 13, by moving the cam disc 15 slightly eccentrically. Thus, an axial distribution movement of this kind can be obtained without any adjustment facilities by an appropriate deviation of the respective arcuate cam zones c and d from a constant radius.

From the foregoing, it will be seen that the present invention provides a relatively simple and versatile mechanical device for imparting axial movement to the ink applicator rollers 11 when they are not transferring ink to the printing plate 13 of a rotary offset printing press.

I claim as my invention:

1. An inking unit for a rotary offset printing machine having a frame, in which the ink is taken from an ink reservoir in metered quantities and distributed by inking rollers to form an ink film which is adapted to be applied to a printing plate covering a portion of the surface of a plate cylinder by means of an axially displaceable ink applicator roller, characterized in that the axially displaceable ink applicator roller performs essentially no axial movement during application of ink to the printing plate which covers the portion of the plate cylinder surface and axial displacement of the ink applicator roller is effected in the phase of a machine cycle in which another portion of the plate cylinder is not covered by the printing plate and the ink applicator roller is not in engagement with the printing plate, comprising, in combination, a cam driven at an integral reciprocal of the plate cylinder speed, a lever pivoted on the machine frame and having a roller engaging the cam, a push rod secured to the lever for movement substantially radially with respect to the applicator roller and means including a bell crank having one arm pinned to the push rod and another arm extending at a right angle thereto for converting radial movement of the push rod to axial movement of the applicator roller, said cam having respective pairs of transition and dwell zones equal in number to the integral of plate cylinder speed and said dwell zones each providing a timing interval substantially equal to the rotational speed interval of a plate covered portion of the plate cylinder surface.

2. An inking unit according to claim 1, characterized in that the magnitude of the axial movement of the ink applicator roller is adjustable by virtue of a variable connection between the lever and the push rod.

3. An inking unit according to claim 2, characterized in that the magnitude of the axial movement of the ink applicator roller is between 6 mm and half the width of the inking zone of an ink dispensing element.

4. An inking unit according to claim 1, comprising a plurality of axially displaceable ink applicator rollers, characterized in that the axial displacement of all the ink applicator rollers is effected in the phase of a machine cycle in which they are not in engagement with the printing plate, the movement of adjacent ink applicator rollers being contra-directional.

5. An inking unit according to claim 4, characterized in that the individual ink applicator rollers have different amounts of axial travel.

6. An inking unit according to claim 1 characterized in that the integral reciprocal of the plate cylinder speed is $\frac{1}{2}$ and the integral of the plate cylinder speed is 2.

7. An inking unit according to claim 6 characterized in that the ratio of the dwell zone to the transition zone is about 3:1.

8. An inking unit according to claim 1 characterized in that the means for connecting the bell crank arm to the applicator roller includes a transmission ring for imparting axial movement.

* * * * *